US007673789B2

(12) United States Patent
DeBusk et al.

(10) Patent No.: US 7,673,789 B2
(45) Date of Patent: Mar. 9, 2010

(54) CARTON WITH OPENING FEATURE AND BLANK

(75) Inventors: Patrick James DeBusk, Larue, TX (US); Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 752 days.

(21) Appl. No.: 11/490,820

(22) Filed: Jul. 21, 2006

(65) Prior Publication Data

US 2007/0017966 A1 Jan. 25, 2007

Related U.S. Application Data

(60) Provisional application No. 60/701,685, filed on Jul. 22, 2005.

(51) Int. Cl.

| | |
|---|---|
| ***B65D 17/00*** | (2006.01) |
| ***B65D 43/00*** | (2006.01) |
| ***B65D 5/00*** | (2006.01) |
| ***A47F 1/04*** | (2006.01) |
| ***B65D 65/00*** | (2006.01) |
| ***B65D 75/00*** | (2006.01) |

(52) U.S. Cl. ..... 229/242; 229/122; 229/160.2; 229/925; 229/240; 206/427; 221/302; 221/305

(58) Field of Classification Search ..... 229/122, 229/240, 242, 160.2, 925; 206/427; 221/302, 221/305

See application file for complete search history.

(56) References Cited

U.S. PATENT DOCUMENTS

| | | | | |
|---|---|---|---|---|
| 2,115,673 | A | 4/1938 | Stompe | |
| 4,396,143 | A * | 8/1983 | Killy | 221/305 |
| 6,283,293 | B1 | 9/2001 | Lingamfelter | |
| 6,866,185 | B2 * | 3/2005 | Harrelson | 229/104 |
| 6,959,857 | B2 * | 11/2005 | Bates | 229/122.1 |
| 7,328,798 | B2 * | 2/2008 | Auclair et al. | 206/427 |
| 2003/0141313 | A1 | 7/2003 | Bates | |
| 2003/0150759 | A1 | 8/2003 | White, Jr. | |
| 2003/0192905 | A1 | 10/2003 | Spivey | |
| 2003/0234285 | A1 | 12/2003 | Bates et al. | |
| 2004/0089671 | A1 | 5/2004 | Miller | |
| 2004/0188277 | A1 | 9/2004 | Auclair | |
| 2004/0188508 | A1 * | 9/2004 | Holley et al. | 229/242 |
| 2006/0065703 | A1 | 3/2006 | DeBusk et al. | |
| 2006/0091191 | A1 | 5/2006 | DeBusk | |
| 2006/0091193 | A1 * | 5/2006 | DeBusk et al. | 229/122.1 |

FOREIGN PATENT DOCUMENTS

| | | |
|---|---|---|
| WO | WO 02/47990 A2 | 6/2002 |
| WO | WO 2004/043790 A2 | 5/2004 |

* cited by examiner

*Primary Examiner*—Gary E Elkins
*Assistant Examiner*—Latrice Byrd
(74) *Attorney, Agent, or Firm*—Womble Carlyle Sandridge & Rice, PLLC

(57) ABSTRACT

A dispensing carton includes a dispenser section having a deformation pattern provided therein. The deformation pattern facilitates removal of the dispenser section during opening of the carton.

21 Claims, 12 Drawing Sheets

CARTON WITH OPENING FEATURE AND BLANK

RELATED APPLICATION

This application claims the benefit of U.S. Provisional Application No. 60/701,685, filed Jul. 22, 2005, the entire contents of which are hereby incorporated by reference.

BACKGROUND

Fully enclosed dispensing cartons having dispensing openings at a top portion of the carton are known. A conventional dispensing carton is typically formed from a unitary paperboard blank having a pattern of tear lines that define a dispensing section of the carton. When the dispensing section is torn away from the carton, containers held within the carton can be removed. Such dispensing sections, however, are difficult to remove because of the stiffness of the paperboard material, which may cause difficulty in gripping the dispensing flap for tearing at the tear lines. The cartons also tend to tear at locations other than along the tear lines defining the dispensing section.

SUMMARY

According to a first embodiment, a carton comprises a first side panel, a top panel, a second side panel, a bottom panel, an exiting end panel, an end panel, and a dispenser section defined at least in part by a dispenser pattern extending at least through the top panel. The dispenser pattern includes a deformation pattern that facilitates gripping of the dispenser section and tearing of the carton along the dispenser pattern during opening of the dispenser.

Other aspects, features, and details of embodiments of the present invention can be more completely understood by reference to the following detailed description of preferred embodiments, taken in conjunction with the drawings figures and from the appended claims.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
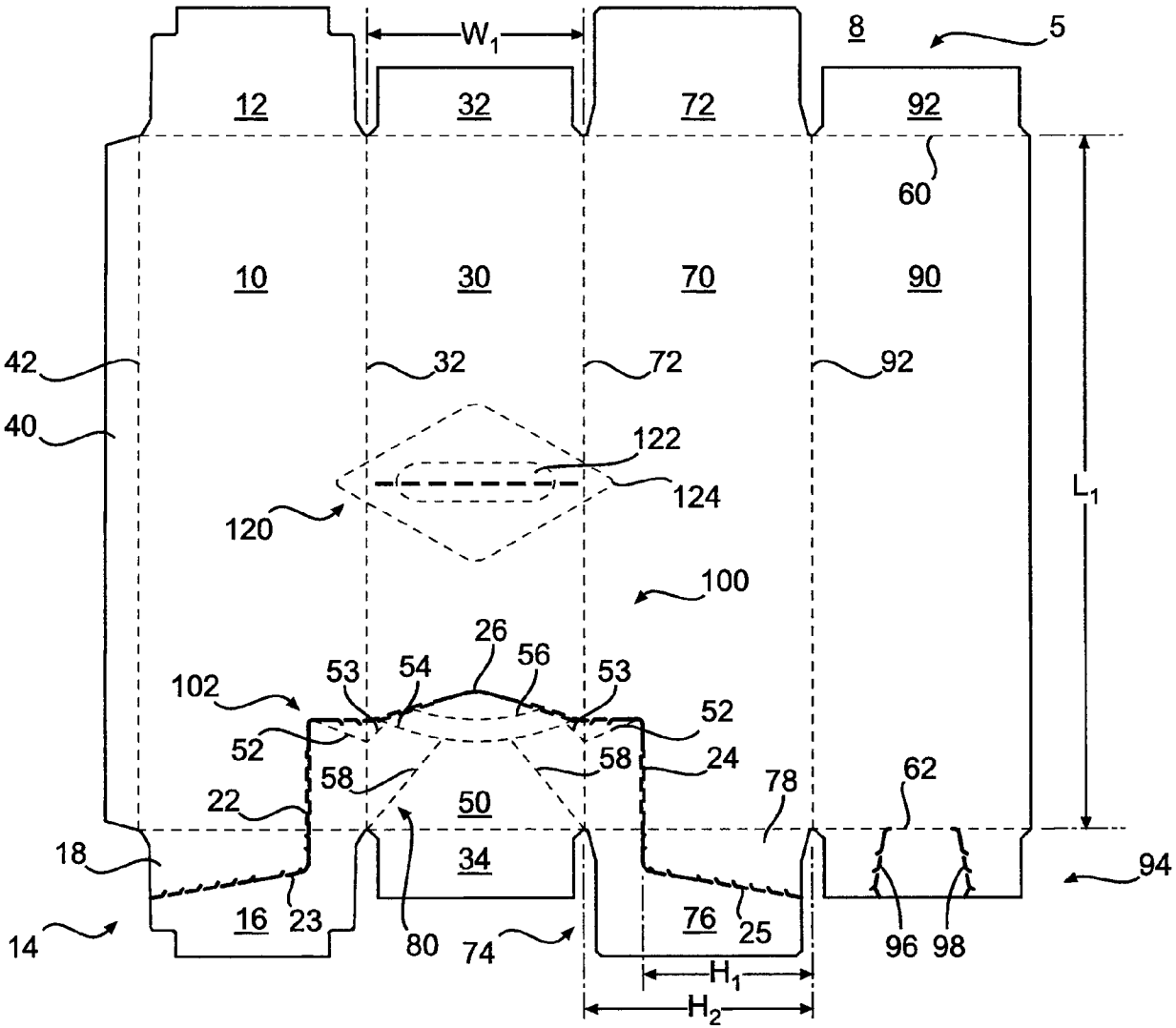
FIG. 1 is a plan view of a blank used to form a carton having a dispenser according to a first embodiment of the invention.

The present invention generally relates to dispensers for cartons having a deformation pattern that allow the dispenser to be easily and reliably opened. The present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the present invention, the following detailed description describes generally cylindrical beverage containers as disposed within the carton embodiments. In this specification, the relative terms "lower,""bottom," "upper" and "top" indicate orientations determined in relation to fully erected cartons. For purposes of the description presented herein, the term "line of disruption"can be used to generally refer to cuts, creases, cut-space lines, cut-creases, tear lines, scores, cut-scores, cuts interspersed with nicks, and combinations of these features. A "breachable" line of disruption is a line of disruption that is intended to be breached during ordinary use of the carton. An example of a breachable line of disruption is a tear line. FIG. 1 is a plan view of a first, underside or interior side 5 of a blank 8 used to form a carton 150 (illustrated in FIG. 4) according to a first embodiment of the invention. The first side 5 of the blank 8 will be disposed in the interior of the erected carton 150. The blank 8 comprises a first side panel 10 foldably connected to a top panel 30 at a first transverse fold line 32, a second side panel 70 foldably connected to the top panel 30 at a second transverse fold line 72, and a bottom panel 90 foldably connected to the second side panel 70 at a third transverse fold line 92. An adhesive flap 40 can be foldably connected to the first side panel 10 at a fourth transverse fold line 42. The blank 8 may include a slotted handle 120 in the top panel 30, or at one or more other locations in the blank.

The first side panel 10 is foldably connected to a first side flap 12 and a first side exiting end flap 14. The top panel 30 is foldably connected to a top flap 32 and a top exiting end flap 34. The second side panel 70 is foldably connected to a second side flap 72 and a second side exiting end flap 74. The bottom panel 90 is foldably connected to a bottom flap 92 and a bottom exiting end flap 94. When the carton 150 is erected, the end flaps 12, 32, 72, 92 close one end of the carton 150, and the exiting end flaps 14, 34, 74, 94 close an exiting end of the carton 150. The end flaps 12, 32, 72, 92 extend along a first marginal area of the blank 8, and may be foldably connected at a first longitudinal fold line 60 that extends along the length of the blank 8. The exiting end flaps 14, 34, 74, 94 extend along a second marginal area of the blank 8, and may be foldably connected at a second longitudinal fold line 62 that extends along the length of the blank 8. The longitudinal fold lines 60, 62 may be, for example, straight or substantially straight fold lines, or may be offset at one or more locations to account for, for example, blank thickness.

Figure 4:
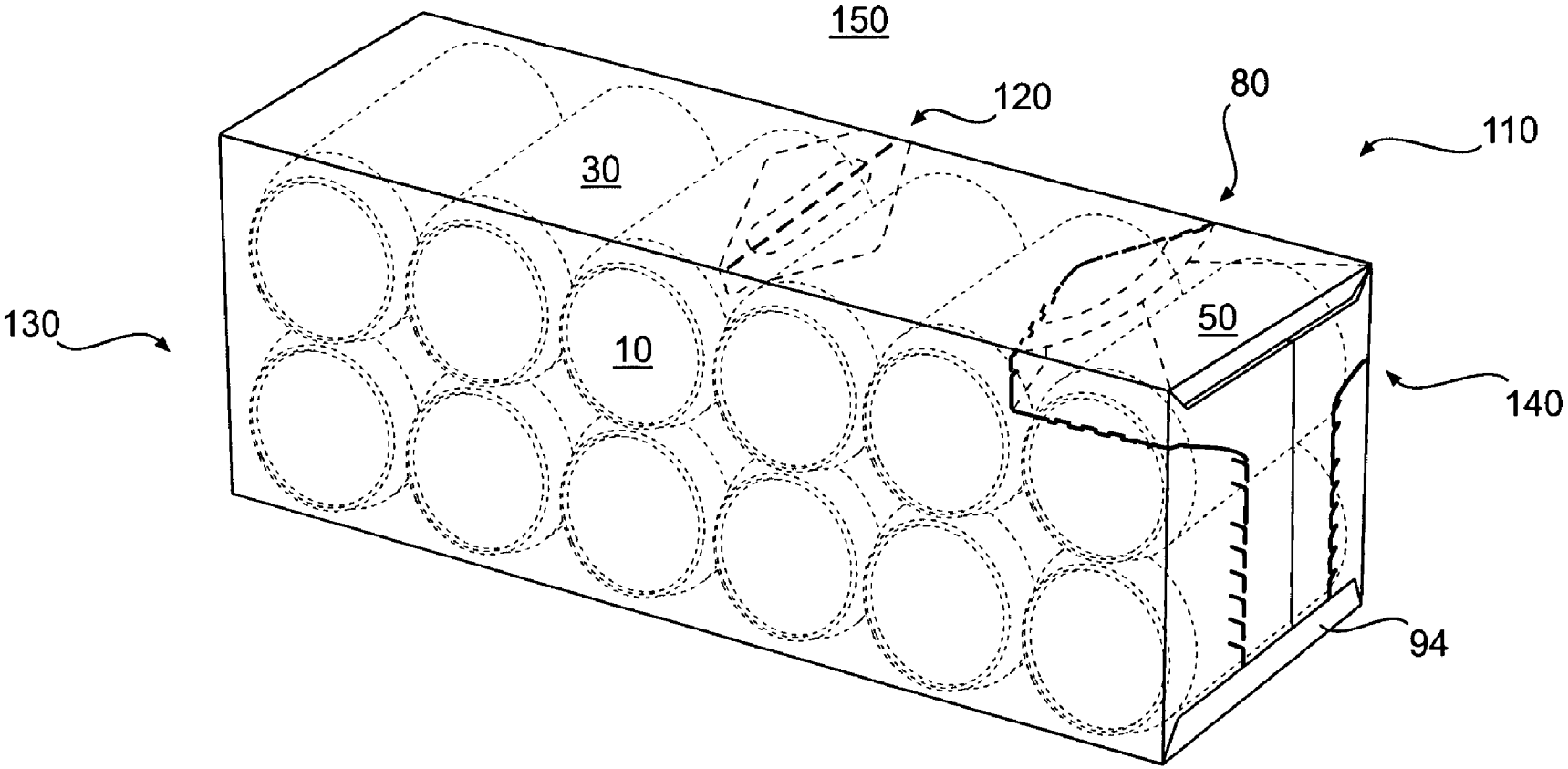
FIG. 4 is a perspective view of the carton according to the first embodiment of the invention.

According to one aspect of the invention, the carton blank 8 includes a dispenser pattern 100 that defines a dispenser 110 in the erected carton 150 (illustrated in FIG. 4). The dispenser pattern 100 includes a tear line pattern 102 and a deformation pattern 80.

The tear line pattern 102 extends across the panels 10, 30, 70 and the exiting end flaps 14, 74, 94. The perimeter of the tear line pattern 102 is defined by first and second side tear lines 22, 24 and a top tear line 26. The first side tear line 22 includes an oblique section 23 that extends obliquely from a side edge of the first side exiting end flap 14. The first side tear line 22 then turns to extend transversely across the longitudinal fold line 62 and into the first side panel 10. The first side tear line 22 divides the first side exiting end flap 14 into a first tear away section 16 and a first retainer section 18. The second side tear line 24 includes an oblique section 25 that extends obliquely from a side edge of the second side exiting end flap 74. The second side tear line 24 then turns to extend transversely across the longitudinal fold line 62 and into the second side panel 70. The second side tear line 24 divides the second side exiting end flap 74 into a second tear away section 76 and a second retainer section 78. The top tear line 26 extends between the first and second side tear lines 22, 24 and may designed to be torn continuously with the first and second side tear lines 22, 24. The top tear line 26 extends across the first and second side panels 10, 70 and across the top panel 30. A center portion of the top tear line 26 includes a generally v-shaped access portion. The tear lines 22, 24, 26 can form a generally continuous breachable line of disruption such as a tear line, or, one or more interruptions can be included in and between the tear lines. The tear line pattern 102 also comprises spaced oblique tear lines 96, 98 in the bottom exiting end flap 94. The tear line pattern 102 defines a removable dispenser section 50 in the erected carton 150.

According to one aspect of the invention, the deformation pattern 80 is a pattern of lines of disruption in the blank 8 that allows the dispenser section 50 to deform during opening of the carton 150. Deformation of the dispenser section 50 allows a user to more easily grasp the dispenser section 50, and also facilitates reliable tearing along the tear line pattern 102 during opening of the dispenser 110. The deformation pattern 80 includes first and second v-shaped edge deformation lines 52, 53 first and second curved, access deformation lines 54, 56, and first and second oblique top deformation lines 58.

A first v-shaped, edge deformation line 52, 53 extends along each end of the top tear line 26. The first v-shaped edge deformation line 52, 53 extends obliquely through the first side panel 10, from the juncture of the tear lines 22, 26, to the transverse fold line 32. At the transverse fold line 32, the first edge deformation line 52, 53 extends obliquely through the top panel 30 towards the first access deformation line 54. Similarly, the second v-shaped edge deformation line 52, 53 extends obliquely through the second side panel 70, from the juncture of the tear lines 24, 26, to the transverse fold line 72. At the fold line 72, the second v-shaped edge deformation line 52, 53 extends obliquely through the top panel 30 towards the first access deformation line 54.

The first and second access deformation lines 54, 56 are disposed in the dispenser section 50 with their concave faces opposing the generally v-shaped central portion of the top tear line 26. The first access deformation line 54 may extend across substantially all of the width of the top panel 30, and may extend adjacent to the top tear line 26 at each end of the deformation line 54. The first curved access deformation line 54 may be, for example, arcuate in shape, with the concave portion of the arc opposing the concave section of the top tear line 26. The second curved access deformation line 56 may extend across at least about one third of the width of the top panel 30, and may extend adjacent to the top tear line 26 at each end of the deformation line 56. The second access deformation line 56 may be, for example, arcuate in shape, with the concave portion of the arc opposing the concave section of the top tear line 26. The access deformation lines 54, 56 are illustrated as generally arcuate, although other shapes are possible. For example, the access lines 54, 56 may have a v-shape.

First and second oblique top deformation lines 58 extend from at or adjacent to respective corners of the dispenser section 50, and converge toward one another as they approach the first access deformation line 54. The first and second oblique top deformation lines 58 can intersect with or extend to points adjacent to the first curved deformation line 54.

The top panel 30 can have a width $W_1$ that generally corresponds to a height of a container C to be held within the carton 150. The first and second retainer sections 18, 78 can each have a height $H_1$ selected to retain a container or containers C within the carton 150, as discussed in further detail below. The side panels 10, 70 have a height $H_2$ that generally corresponds to the height of the carton 150. Erection of the carton 150 is discussed below with reference to FIGS. 2-4.

Figure 2:
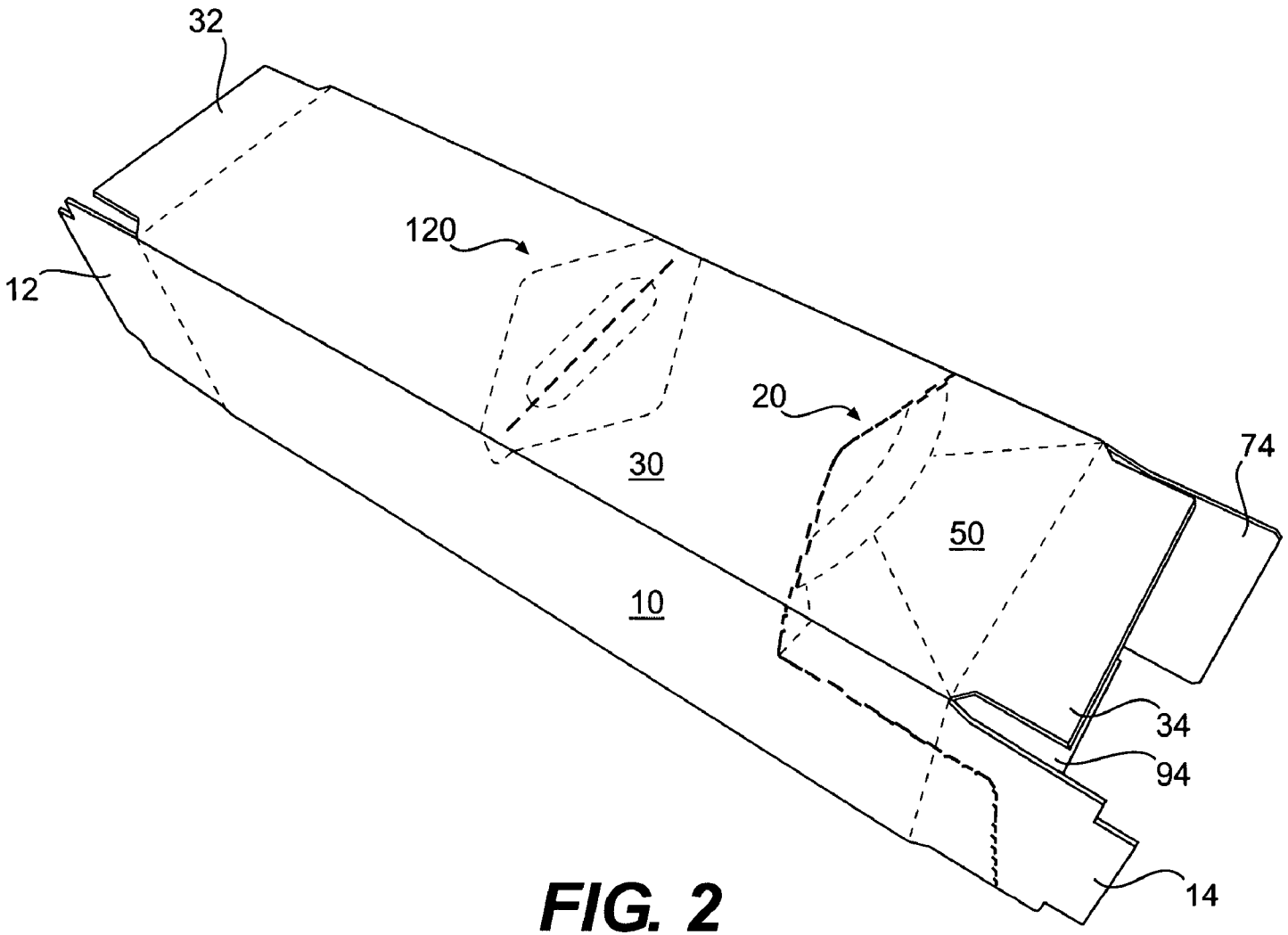
FIG. 2 is a perspective view of the carton blank in a partially erected state.
Figure 3:
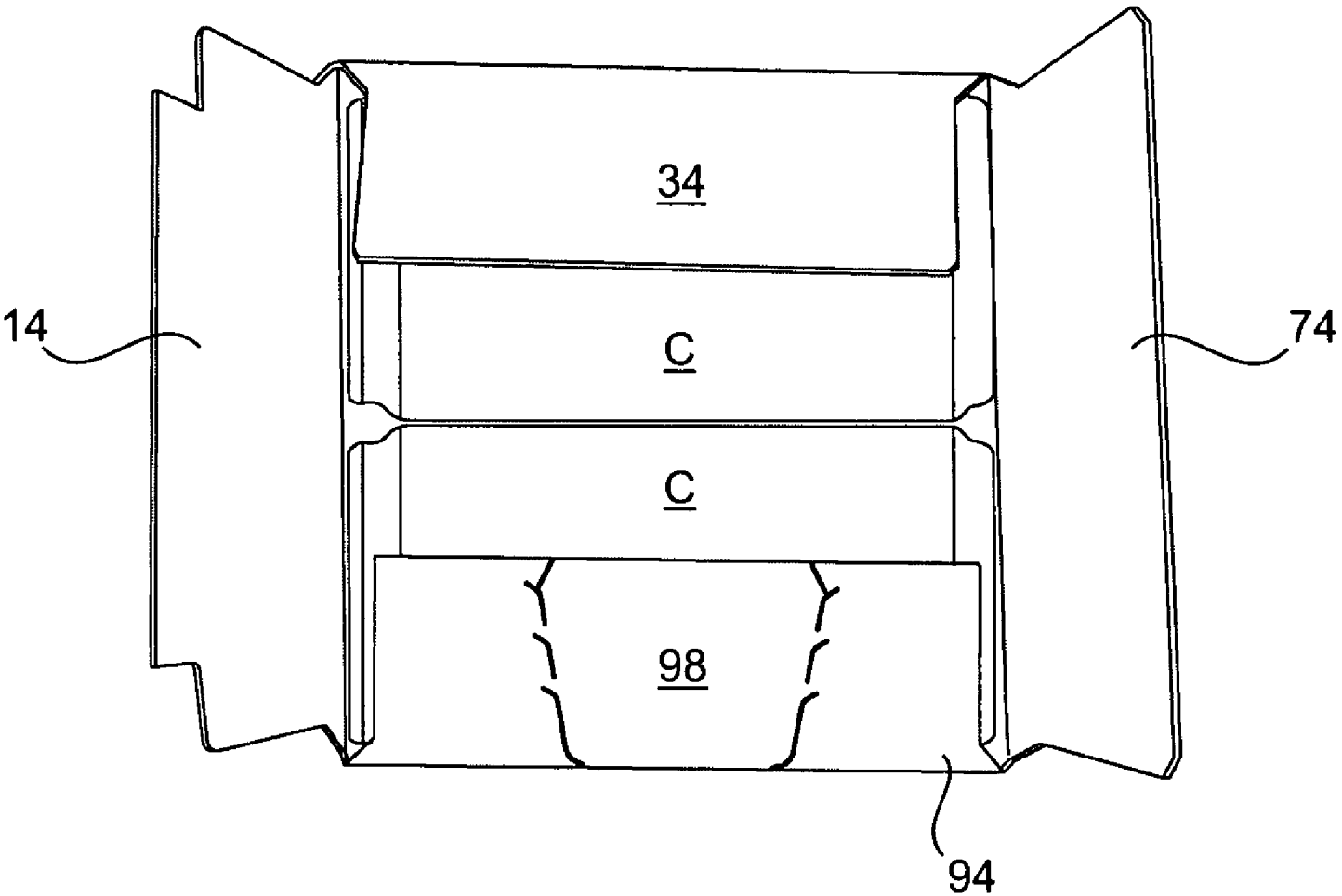
FIG. 3 is an end view of the carton blank in a partially erected state.

FIG. 2 is a perspective view of an erection step of the carton 150. The carton 150 is erected by gluing the adhesive flap 40 (shown in FIG. 1) to the bottom panel 90 so that the first side panel 10, the top panel 30, the second side panel 70, and the bottom panel 90 may be opened into a generally tubular form or sleeve, as shown in FIG. 2. The back end of the tubular sleeve is closed by folding the end flaps 32, 92 across the open back end of the tubular form, folding the side end flap 12 over the flaps 32, 92 and adhering the flaps together, and then folding the side end flap 72 over the flaps 12, 32, 92 and adhering the flap 72 thereto. Similarly, referring to FIG. 3, the exiting end of the tubular sleeve is closed by folding the exiting end flaps 34, 94 across the open exiting end of the tubular form, folding the side exiting end flap 14 over the flaps 34, 94 and adhering the flaps together, and then folding the side exiting end flap 74 over the flaps 14, 34, 94 and adhering the flap 74 thereto. FIG. 3 illustrates the exiting end flaps 14, 34, 74, 94 being closed over containers C loaded inside the tubular sleeve. The containers C may be loaded into the sleeve in a conventional manner before one or both ends of the tubular form are closed. In the exemplary embodiment, the carton 150 encloses twelve 12-ounce beverage containers C. The containers C are arranged in the carton 150 in a 2×6×1 configuration.

FIG. 4 is a perspective view of the carton 150 constructed from the blank illustrated in FIG. 1. The carton 150 is parallelepipedal in shape. In the erected carton 150, the end flaps 12, 32, 72, 92 form a first end panel 130 and the exiting end flaps 14, 34, 74, 94 form an exiting end panel 140. The dispenser 110 extends across the side panels 10, 70, the top panel 30, and the exiting end panel 140, and comprises the removable dispenser section 50. In FIG. 4, the 2×6×1 arrangement of containers C is indicated by hidden lines.

Figure 5:
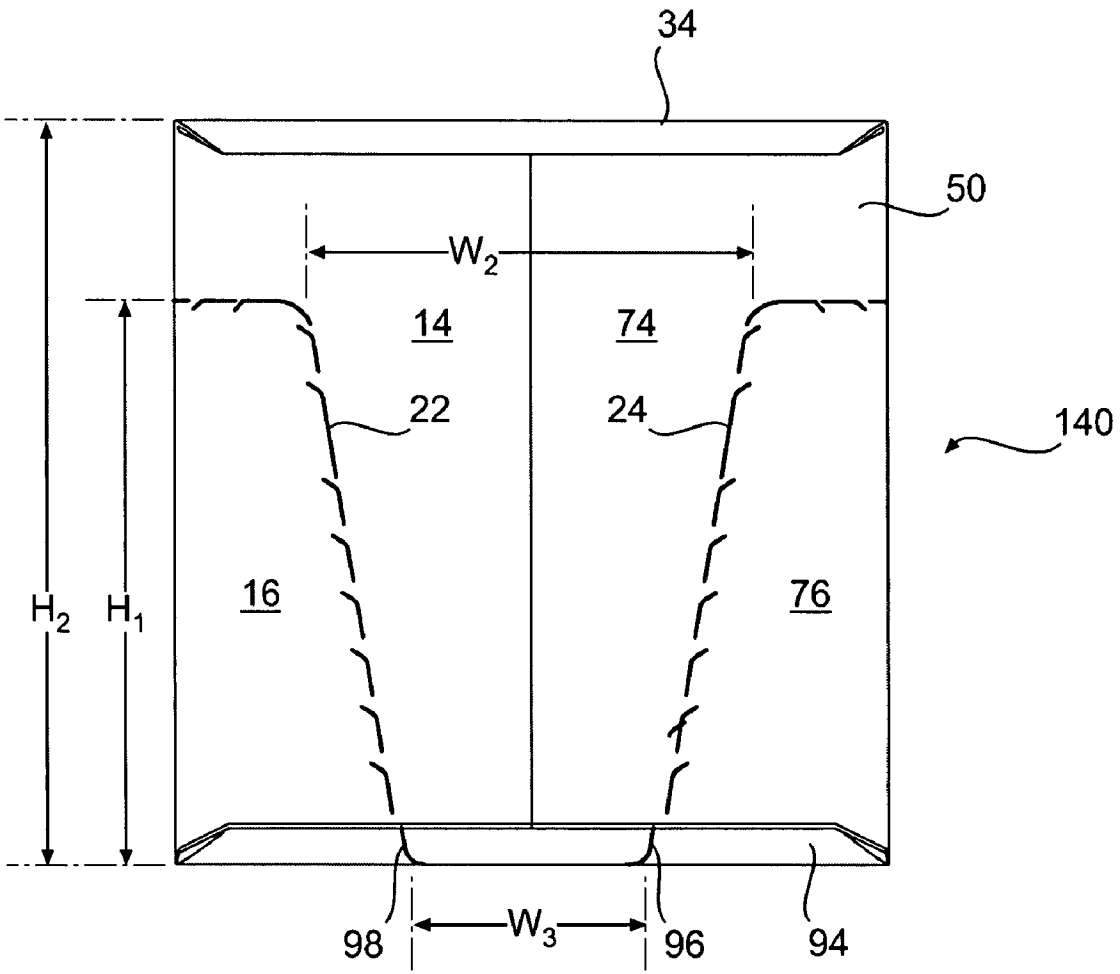
FIG. 5 is an end view of the exiting end of the carton.

FIG. 5 is an end view of the carton 150. As shown in FIG. 5, the first and second side tear lines 22, 24 of the dispenser 110 can be separated by a width $W_2$ at the tops of the retainer sections 16, 76, and may converge to a width $W_3$ at or adjacent to the bottom of the exiting end panel 140. The width $W_2$ may be selected to optimize the ease of removal of containers C from the carton 150 once the dispenser 110 is opened. The retainer sections 16, 76 may extend to uppermost points having a height Hi that is shorter than a height $H_2$ of the carton 150. The height HI may be selected, for example, to retain an uppermost row or layer of containers C within the carton once the dispenser 110 is opened, as is discussed in further detail below.

Figure 6:
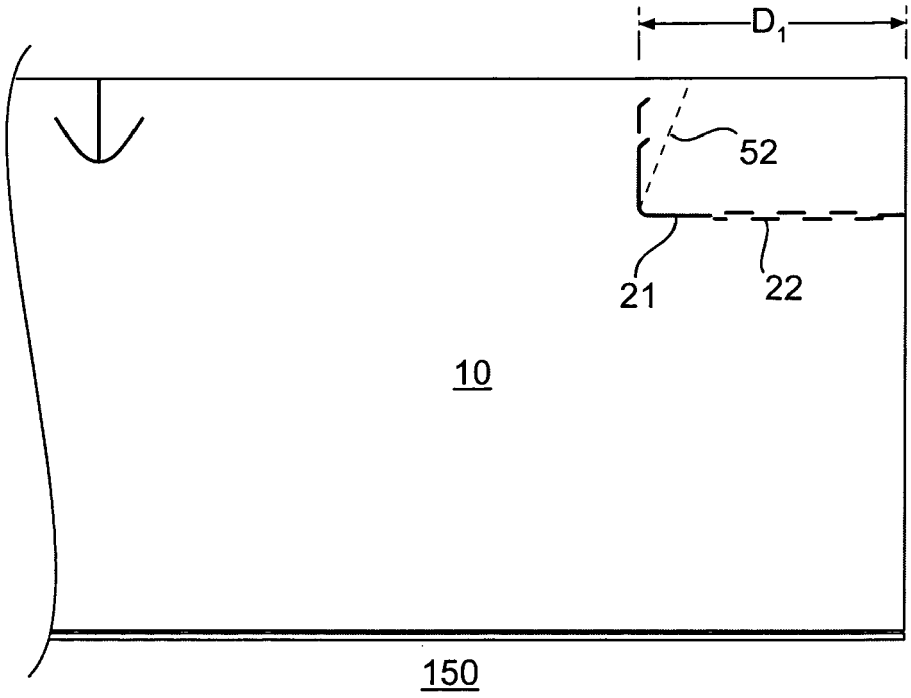
FIG. 6 is a partial left side view of the carton.
Figure 7:
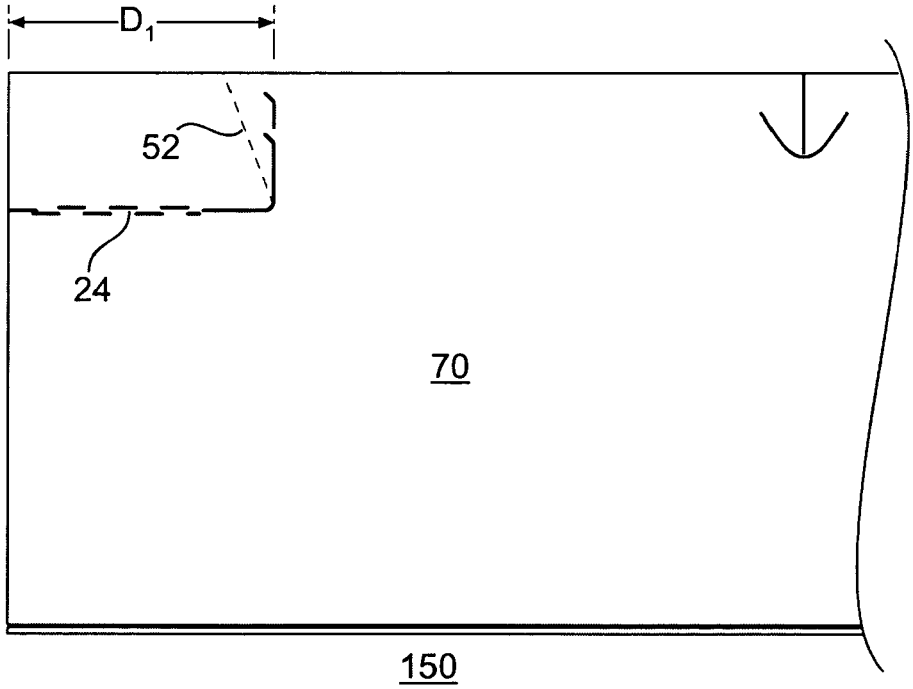
FIG. 7 is a partial right side view of the carton.
Figure 8:
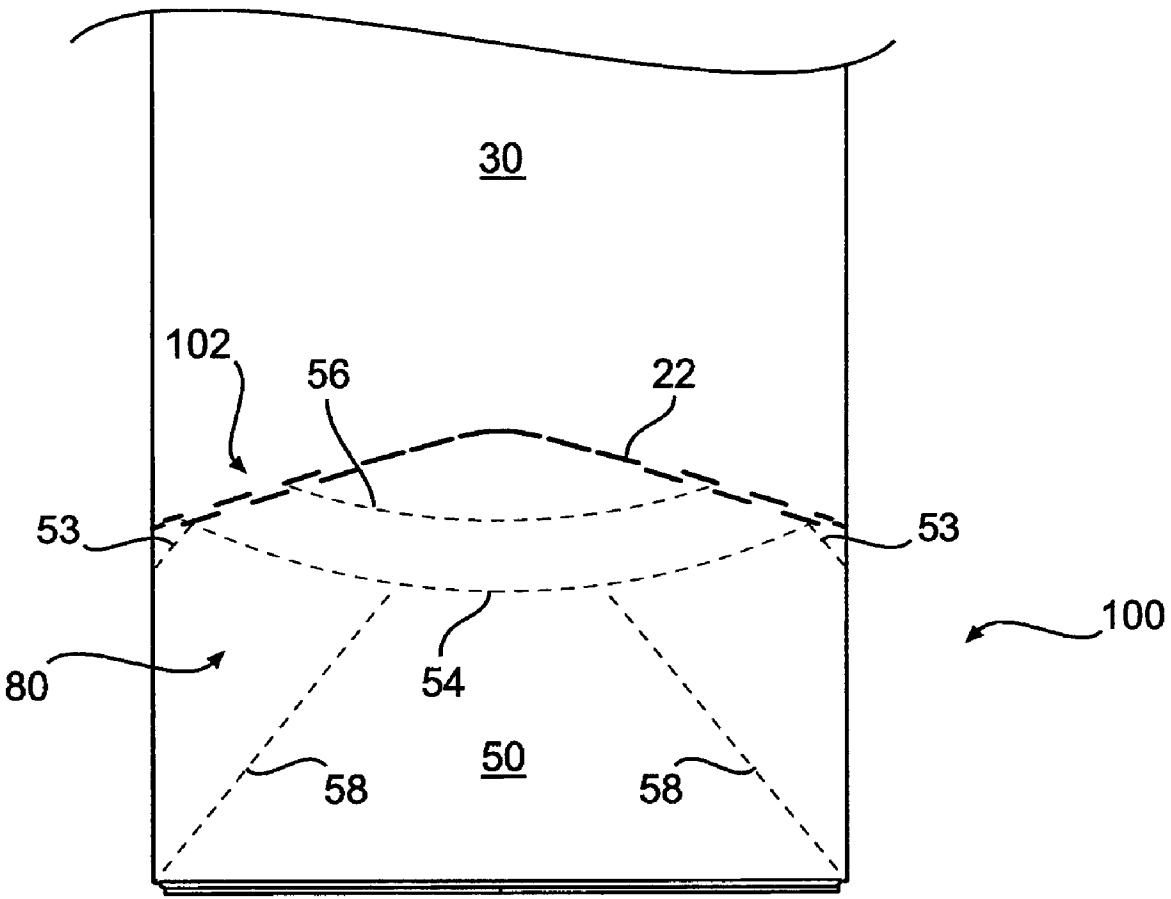
FIG. 8 is a top plan view of the carton.

FIGS. 6 and 7 are side views of the carton 150, and illustrate the depth $D_1$ to which the first and second side tear lines 22, 24 extend into the first and second side panels 10, 70, respectively. FIG. 8 is a top view of the carton 150. As shown in FIG. 8, the first and second oblique top deformation lines 58 extend from respective upper corners of the dispenser section 50 and may connect to or extend adjacent to the first, curved access deformation line 54 of the deformation pattern 80.

Figure 9:
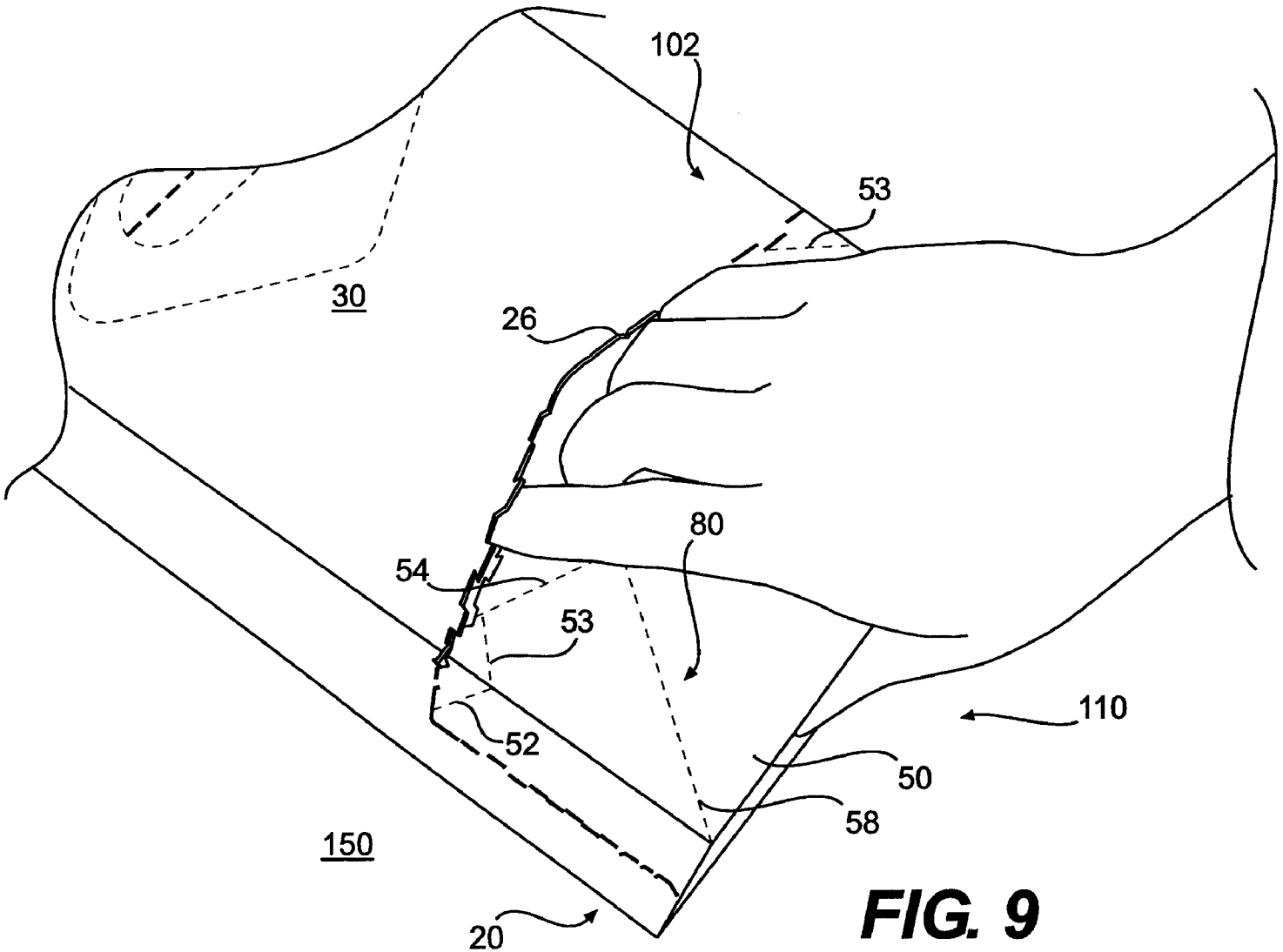
FIGS. 9-12 illustrate the carton dispenser being opened.

FIG. 9 is a perspective view of the dispenser 110 being opened. Opening may be begun by pressing downwardly on the top panel 30 between the top tear line 26 of the tear line pattern 102 and the first curved deformation line 54 of the deformation pattern 80 so that the top panel 30 tears along the top tear line 26. At this stage, gripping of the dispenser section 50 and tearing along the top tear line 26 is facilitated by deformation of the top panel 30 at the first and second curved access deformation lines 54, 56 of the deformation pattern 80. The upper edges of the carton 150 may also begin to flex inwardly at the first and second v-shaped edge deformation lines 52. The first and second curved access deformation lines 54, 56 allow the dispenser section 50 to flex inwardly to facilitate access to the dispenser section 50 during tearing.

Figure 10:
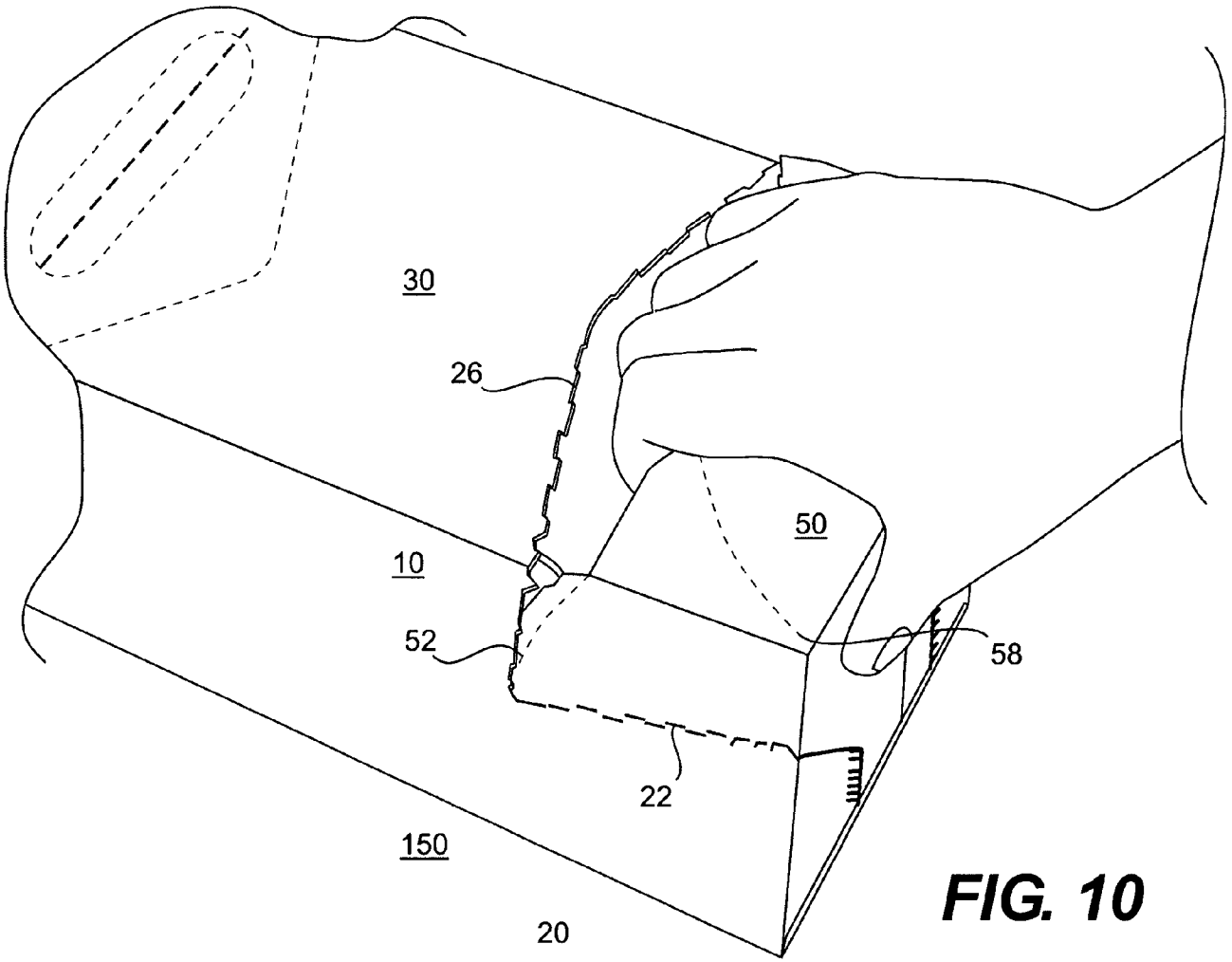
Figure 11:
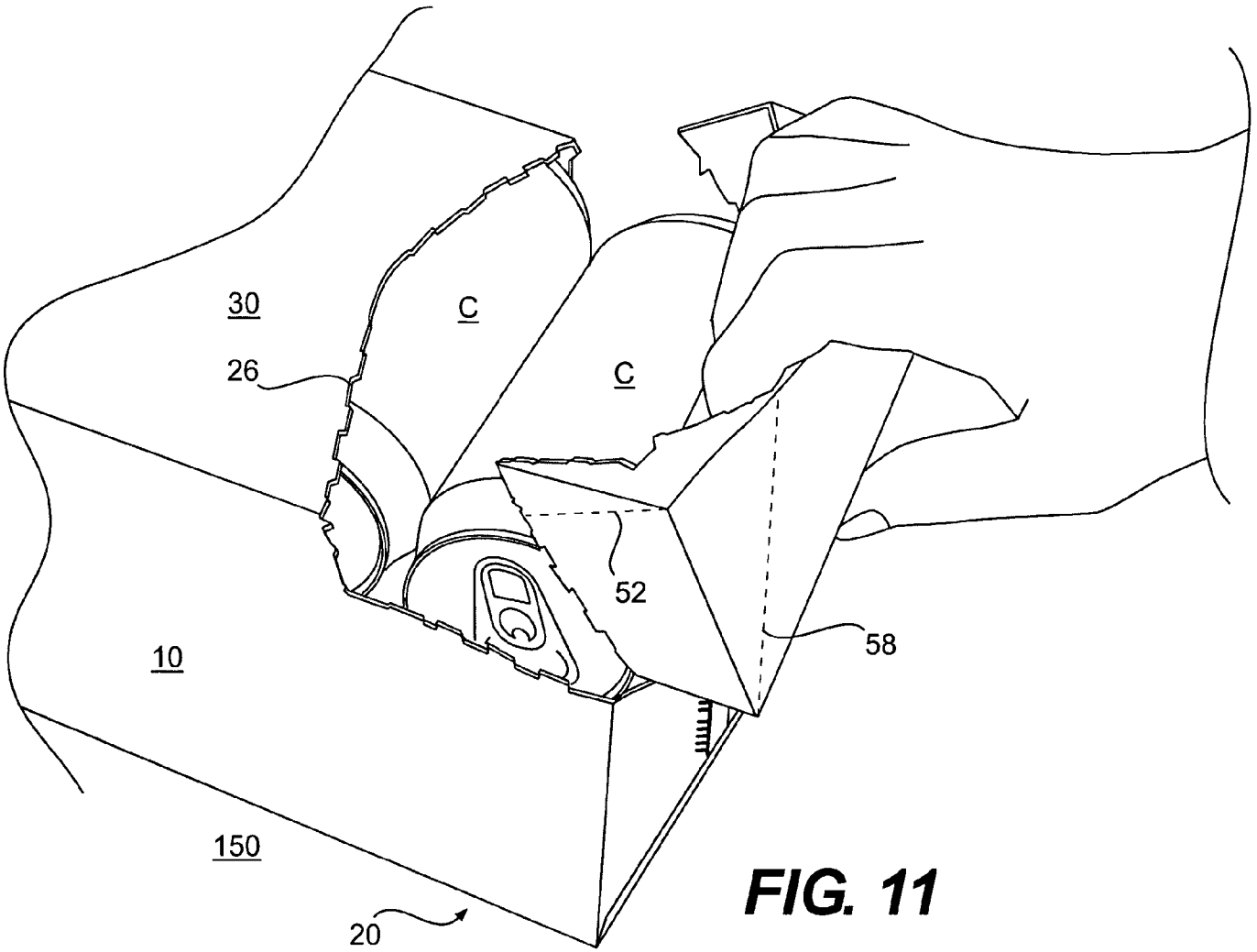

Referring to FIGS. 10 and 11, the tear line pattern 102 is further torn long the first and second side tear lines 22, 24 (see also FIGS. 6 and 7), which extend down the first and second side panels 10, 70, respectively. Referring also to FIG. 1, a center portion of the bottom exiting end panel 94 disposed between the tear lines 96, 98 may be adhered to the tear away sections 16, 76, and is removed during opening of the dispenser 110. During opening of the dispenser 110, gripping of the dispenser section 50 and tearing along the tear line pattern 102 is facilitated by further deformation of the top panel 30 at the deformation lines 54, 56, 58, and inward deformation of the upper edges of the carton 150 at the v-shaped deformation lines 52, 53.

Figure 12:
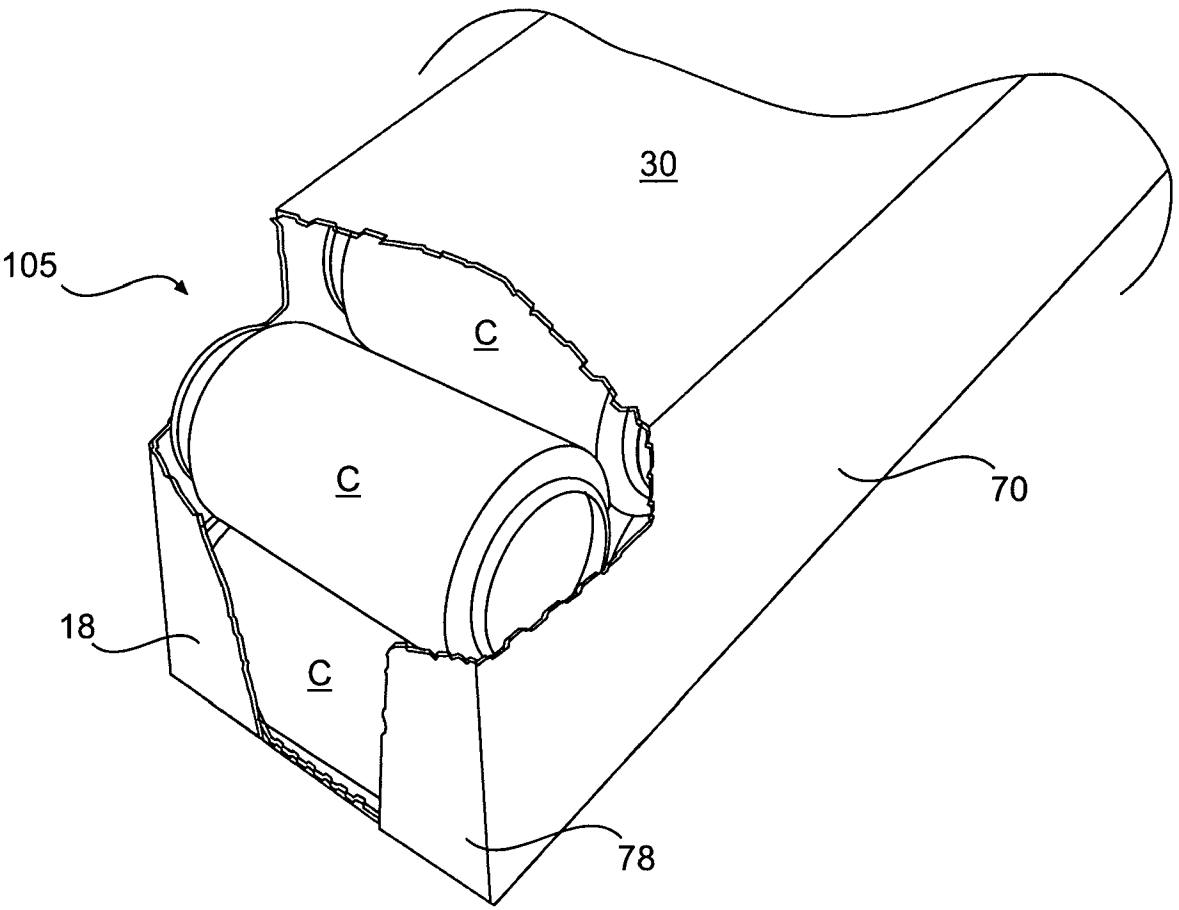

FIG. 12 is a perspective view of the carton 150 with the dispenser 110 opened, leaving a dispenser opening 105. With the dispenser section 50 removed, the container C in the top or uppermost row or layer adjacent to the dispenser opening can be easily accessed and removed from the carton 150. Also, the dispenser opening 105 may extend downward in the exiting end panel 140 such that containers C in the lower row are also accessible by hand.

Figure 13:
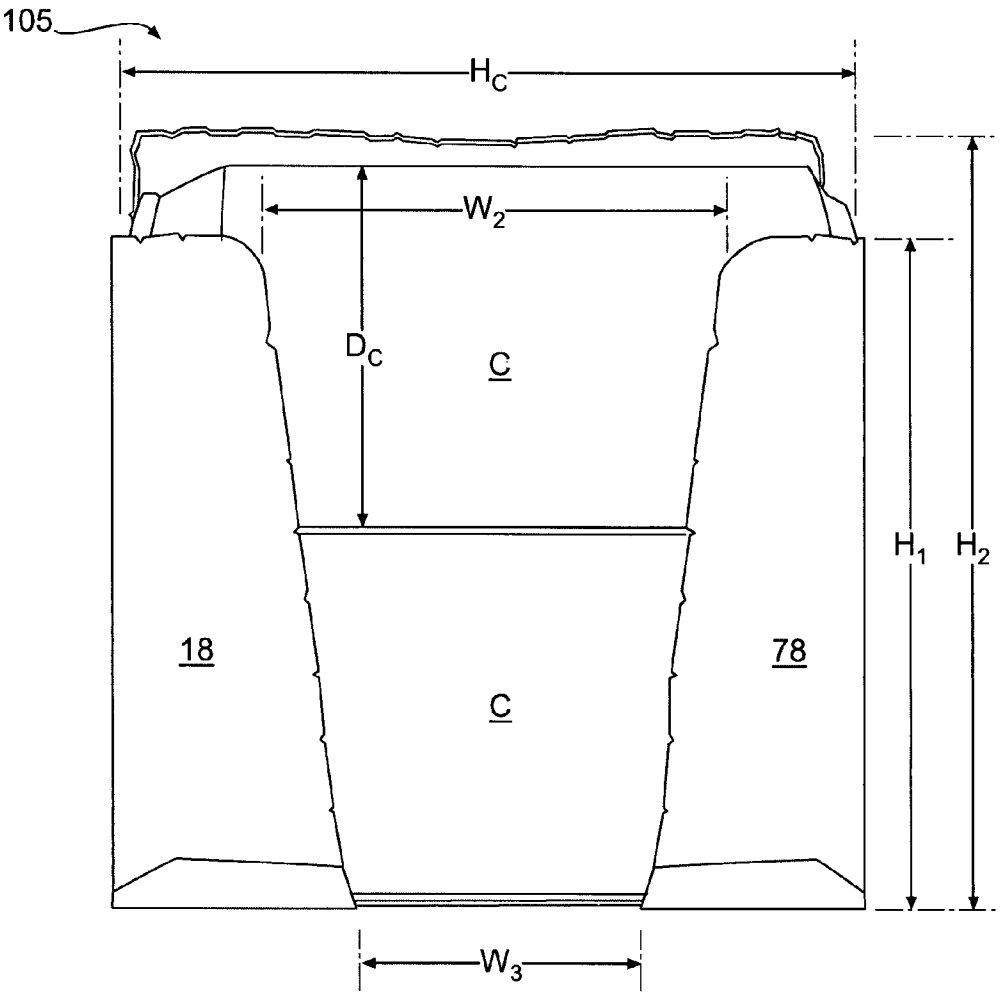
FIG. 13 is a perspective view of the carton with the dispenser opened.

FIG. 13 is an end view of the carton 150 illustrating the exiting end panel 140 after opening the dispenser 100. As shown in FIG. 13, the containers C may be generally cylindrical in shape and may have a height $H_C$ and a diameter $D_C$. The height $H_1$ of the retainer sections 18, 78 may be selected to retain the container in the uppermost row of containers. For example, the height $H_1$ can be in the range of about 110-200% of the container diameter $D_C$. In other embodiments, the height $H_1$ can be in the range of about 130-180% of the container diameter $D_C$. The upper width $W_2$ may be between about 30-90% of the height $H_C$ of the containers C or the carton width $W_1$ (shown in the FIG. 1). In other embodiments, the width $W_2$ is between about 40-70% of the height $H_C$ or the carton width $W_1$. The lower width $W_3$ may be between about 10-70% of the height $H_C$ of the containers C or the carton width $W_1$. In other embodiments, the width $W_3$ is between about 30-50% of the height $H_C$ or the carton width $W_1$. In general, the widths $W_2$ and $W_3$ between the retainer sections 18, 78 are selected to be large enough so that a user can insert a finger into the dispenser opening 105 and pull a container C upwardly and out through the dispenser opening 105.

EXAMPLE 1

A carton as illustrated in FIGS. 4-13 accommodated twelve 12-ounce cans. The cans were arranged in a 2×6×1 arrangement, as shown in FIG. 4. The curved access deformation lines 54, 56 were generally circular arcs comprised of cut-crease lines, with the cuts extending through the blank (i.e., 100% cuts). The deformation lines 52, 53, 58 were crease lines.

For purposes of illustration, the present invention is generally disclosed in the context of paperboard cartons or packages sized and dimensioned to contain generally cylindrical beverage containers in a two-row configuration with multiple columns of beverage containers included in each row. Other types of containers, however, can be accommodated within a carton according to the present invention. The dimensions of the blank may also be altered, for example, to accommodate various container forms.

The blank 8 can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier row, on either or both sides of the blank. In accordance with the above-described embodiments, the blank may be constructed of paperboard of a caliper such that it is heavier and more rigid than ordinary paper. The blank can also be constructed of other materials, such as cardboard, or any other material having properties suitable for enabling a dispenser to function as described above. The blank can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

A tear line can be any substantially linear, although not necessarily straight, breachable line of disruption that facilitates tearing therealong. Specifically, but not for the purpose of narrowing the scope of the present invention, tear lines include: a cut that extends partially into the material along the desired line of weakness, and/or a series of cuts that extend partially into and/or completely through the material along the desired line of weakness, or various combinations of these features. As a more specific example, one type of tear line is a series of cuts that extend completely through the material, with adjacent cuts being spaced apart slightly so that small somewhat bridge-like pieces of the material (e.g., 'nicks') are defined between adjacent cuts. The nicks are broken during tearing along the tear line. Such a tear line that includes nicks can also be referred to as a cut line, since the nicks typically are a relatively small in relation to the cuts.

The term "line" as used herein includes not only straight lines, but also other types of lines such as curved, curvilinear or angularly displaced lines.

The above embodiments may be described as having one or panels adhered together by glue. The term "glue" is intended to encompass all manner of adhesives commonly used to secure paperboard carton panels in place.

In the present specification, a "panel" or "flap" need not be flat or otherwise planar. A "panel" or "flap" can, for example, comprise a plurality of interconnected generally flat or planar sections.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed:

1. A blank for forming a carton, comprising:

a first side panel;

a top panel; the first side panel and the top panel being connected along a first fold line;

a second side panel;

a bottom panel;

at least one first flag extending along a first marginal area of the blank; the at least one first flap including a first top panel end flag connected alone a first transverse fold line to the top panel and a first side panel end flay connected along the first transverse fold line to the first side panel, and at least one second flag extending along a second marginal area of the blank, wherein a dispenser section is defined by a dispenser pattern extending at least through the top panel and into the first side panel, wherein the dispenser pattern comprises a tear line pattern and a deformation pattern formed in the dispenser section that facilitates deformation of the dispenser section, the tear line pattern including a first side tear line in the first side panel extending from the first fold line in a first direction to a first turn then extending from the first turn in a second direction to the first transverse fold line, the deformation pattern including a first deformation line extending from the first fold line to the first turn;

wherein the tear line pattern comprises a top tear line in the top panel and the deformation pattern includes a second deformation line in the top panel extending from the top tear line to the first fold line.

2. A blank for forming a carton, comprising:

a first side panel;

a top panel; the first side panel and the ton panel being connected along a first fold line;

a second side panel;

a bottom panel;

at least one first flap extending along a first marginal area of the blank; the at least one first flap including a first top panel end flap connected along a first transverse fold line to the top panel and a first side panel end flay connected along the first transverse fold line to the first side panel, and at least one second flan extending alone a second marginal area of the blank, wherein a dispenser section is defined by a dispenser pattern extending at least through the top panel and into the first side panel, wherein the dispenser pattern comprises a tear line pattern and a deformation pattern formed in the dispenser section that facilitates deformation of the dispenser section, the tear line pattern including a first side tear line in the first side panel extending from the first fold line in a first direction to a first turn then extending from the first turn in a second direction to the first transverse fold line, the deformation pattern including a first deformation line extending from the first fold line to the first turn;

wherein the deformation pattern comprises two curved access deformation lines;

wherein the deformation pattern comprises a first oblique deformation line extending outwardly from one of the two curved access deformation lines to the first transverse fold line.

3. The blank of claim 2, wherein the deformation pattern comprises a second oblique deformation line extending outwardly from one of the two curved access deformation lines to the first transverse fold line.

4. A blank for forming a carton, comprising:

a first side panel;

a top panel; the first side panel and the top panel being connected alone a first fold line;

a second side panel;

a bottom panel;

at least one first flap extending along a first marginal area of the blank; the at least one first flap including a first top panel end flap connected along a first transverse fold line to the top panel and a first side panel end flap connected along the first transverse fold line to the first side panel, and at least one second flap extending along a second marginal area of the blank, wherein a dispenser section is defined by a dispenser pattern extending at least through the top panel and into the first side panel, wherein the dispenser pattern comprises a tear line pattern and a deformation pattern formed in the dispenser section that facilitates deformation of the dispenser section, the tear line pattern including a first side tear line in the first side panel extending from the first fold line in a first direction to a first turn then extending from the first turn in a second direction to the first transverse fold line, the deformation pattern including a first deformation line extending from the first fold line to the first turn;

wherein the top panel is connected to the second side panel along a second fold line and wherein the tear line pattern includes a second tear line extending in a first direction from the second fold line to a second turn then in a second direction to the first transverse fold line and wherein the deformation pattern comprises a third deformation line extending from the second fold line to the second turn;

wherein the deformation pattern includes at least one curved access deformation line and a fourth deformation line extending in the top panel from the at least one curved access deformation line to the second fold line.

5. The blank of claim 4, wherein the third and fourth first and second deformation lines are v-shaped.

6. A carton, comprising:

a first side panel;

a top panel; the first side panel and the top panel being connected along a first fold line;

a second side panel;

a bottom panel;

an end panel; and an exiting end panel, wherein a dispenser section is defined by a dispenser pattern extending at least through the top panel and into the first side panel, wherein the dispenser pattern comprises a tear line pattern and a deformation pattern formed in the dispenser section that facilitates deformation of the dispenser section, the tear line pattern including a first side tear line in the first side panel extending from the first fold line in a first direction to a first turn then extending from the first turn in a second direction to the first transverse fold line, the deformation pattern including a first deformation line extending from the first fold line to the first turn;

wherein the tear line pattern comprises a top tear line in the top panel and the deformation pattern includes a second deformation line in the top panel extending from the top tear line to the first fold line.

7. The carton of claim 6, wherein the deformation pattern comprises a first oblique deformation line extending outwardly from one of the two curved access deformation lines to the first transverse fold line.

8. The carton of claim 7, wherein the top panel is connected to the second side panel along a second fold line and wherein the tear line pattern includes a second tear line extending in a first direction from the second fold line to a second turn then in a second direction to the first transverse fold line and wherein the deformation pattern comprises a third deformation line extending from the second fold line to the second turn.

9. The carton of claim 8, wherein the deformation pattern includes at least one curved access deformation line and a fourth deformation line extending in the top panel from the at least one curved access deformation line to the second fold line.

10. The carton of claim 9, wherein the deformation pattern comprises a second edge deformation line extending across a second upper edge of the carton between the second side panel and the top panel.

11. The carton of claim 10, wherein the third and fourth edge deformation lines are v-shaped.

12. The carton of claim 7, wherein:

the top tear line extends from the first side tear line to the second side tear line.

13. The carton of claim 12, wherein the first side tear line and the second side tear line extend through the exiting end panel.

14. The carton of claim 12, further comprising a plurality of generally cylindrical containers disposed within the carton.

15. The carton of claim 14, wherein the generally cylindrical containers have a height and at least one common diameter, and wherein the first side tear line in part defines a first retainer section in the exiting end panel and the second side tear line in part defines a second retainer section in the exiting end panel.

16. The carton of claim 15, wherein a height of the first retainer section is in the range of 110-200% of the common diameter.

17. The carton of claim 16, wherein a top portion of the first retainer section is separated from a top portion of the second retainer section by a distance in the range of 30-90% of the container height.

18. The carton of claim 17, wherein a bottom portion of the first retainer section is separated from a bottom portion of the second retainer section by a distance in the range of 10-70% of the container height.

19. The carton of claim 18, wherein a height of the carton is approximately equal to an integral multiple of the common diameter.

20. The blank of claim 1, wherein the first and second deformation lines are v-shaped.

21. The carton of claim 10, wherein the first and second deformation lines are v-shaped.

* * * * *